US010591244B1

(12) United States Patent
Bowmar

(10) Patent No.: US 10,591,244 B1
(45) Date of Patent: Mar. 17, 2020

(54) BOWMAR NOSE BUTTON

(71) Applicant: Josh Bowmar, Westerville, OH (US)

(72) Inventor: Josh Bowmar, Westerville, OH (US)

( * ) Notice: Subject to any disclaimer, the term of this patent is extended or adjusted under 35 U.S.C. 154(b) by 0 days.

(21) Appl. No.: 16/378,480

(22) Filed: Apr. 8, 2019

Related U.S. Application Data

(60) Provisional application No. 62/775,283, filed on Dec. 4, 2018.

(51) Int. Cl.
*F41B 5/14* (2006.01)

(52) U.S. Cl.
CPC ..... *F41B 5/1423* (2013.01); *Y10T 428/139* (2015.01); *Y10T 428/1393* (2015.01); *Y10T 428/1397* (2015.01)

(58) Field of Classification Search
CPC ..... F41B 5/1423; Y10T 428/139; Y10T 428/1393; Y10T 428/1397
See application file for complete search history.

(56) References Cited

U.S. PATENT DOCUMENTS 6,131,295 A 10/2000 Cranston
6,571,787 B2 6/2003 Remaklus

*Primary Examiner* — Michael C Miggins

(57) ABSTRACT

An archery aiming aid clips to a bow string and may be fixed at a position along the string so that an archer may draw the bow such that the bead contacts the archer's nose.
An archer is able to hold the bow in a repeatable configuration of outstretched limbs and relative positions of the hands, the bow grip, the depth of draw of the bow string, the apex of the drawn bow string and an arrow nocked therein, and other factors relating to the mechanical energy stored in the bow and imparted to the arrow when released.
An archer is able to build muscle memory so that from one shot to the next the archer may repeatably re-establish the same stored energy configuration in the body and bow, and the same parallax between the archers line of sight and the shooting axis of the bow, so that improved uniformity of trajectories is achieved, point of impact is learned and controlled more accurately, and thus the archers accuracy and effectiveness is increased.

18 Claims, 3 Drawing Sheets

BOWMAR NOSE BUTTON

CROSS REFERENCE TO RELATED APPLICATION

This non-provisional utility application claims the benefit of and priority to U.S. Provisional Patent Application 62/775,283 "Nose Button" filed 4 Dec. 2018. The entire contents of U.S. Provisional Patent Application 62/775,283 "Nose Button" filed 4 Dec. 2018 are hereby incorporated into this document by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to an aiming aid for target archery and bow hunting.

BACKGROUND

In archery, the point of impact of an arrow and its tip is influenced by several simultaneous parameters, most notably the distance to which the bowstring is drawn back and the elevation angle at which an arrow is launched.

An archer must develop a skill set which combines a keen sense of proprioception and "muscle memory" in various body positions in order to make a good estimate of both how far back an arrow nocked to its bowstring has been drawn and also the elevation angle of the arrow. Accuracy is gained by repeated visceral learning experiences of which muscle positions of the entire body result in which ranges and impact points of the arrows. According to some techniques, an archer sights along an arrow shaft, but in other techniques the arrow axis at launch is offset from a line of sight from the archer's aiming eye to the target or to an aiming structure on the bow, arrow, or string, so that the repeatable control of a launch angle must also be learned by experience and muscle memory which is not often or easily transferrable from one bow and arrow system to another, nor easily transferable from one user to another user of the same system. Thus, despite its ancient history, many challenges for repeatability and reproducibility remain unsolved in the field of archery.

BRIEF DESCRIPTION

Many existing sighting aids for archery help correlate distance of impact only to an elevation angle at which a bow is held, but without regard to depth of draw of the bow string. A "sight picture" is composed of a visual image or view of the bow parts and arrow parts in the near field combined with the view of the target at a distance.

It is disadvantageously possible for a user of an archery sighting system to create the same "sight picture" while the energy stored in the bow varies, which results in the same sight picture yielding different arrow impact points. It is therefore a primary objective of the invention to offer a new sighting device and method by which an equivalent sight picture to that of a previous shot provides much more nearly the same impact result as the previous shot.

Another objective of the invention is to provide means by which an archer may repeatably establish the same depth of draw of a bow from one shot to the next, providing that other variables such as arrow length and mass are reasonably similar. A corollary objective of the invention is to enable a user to reestablish the same depth of draw of a bow by reestablishing the sight picture and relative positions of the bow, the eye, the arrow and its tip, and any sighting structures in the vicinity of the grip or arrow rest, so that whenever these visual components are organized the same as for a previous shot with the same arrow, then the same point of impact for the arrow may be expected and achieved.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Although archery for sport, for hunting to procure food, and for waging war predates written history, accessories and methods have developed and evolved over time and new inventions continually contribute to and improve the art and skill of archery, beginning with the basics of storing mechanical energy in a bow, temporarily coupling a nock of an arrow to the bow, resting a forward portion of the arrow on a portion of the bow, and releasing the stored energy so that it is transferred into substantially longitudinal acceleration of the arrow, which then flies to a target or intended point of impact and is usually stabilized while in flight.

Figure 1:
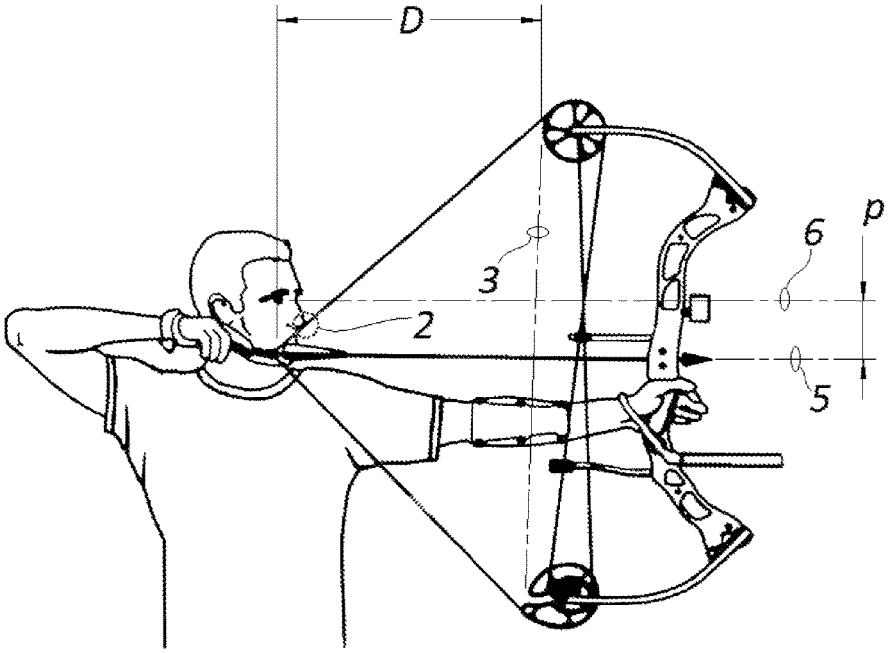
FIG. 1 shows bow in a drawn position to define a depth of draw 'D' and to illustrate some contemporary archery accessories.

FIG. 1 shows an archer holding a bow in a drawn position and using some contemporary archery accessories, including an arm guard and a wrist release. Phantom line [3] represents a bowstring in a slack position, and dimension 'D' defines a depth of draw from the slack position to a drawn position when the archer will be visually aiming the bow and its nocked arrow. Typically the line of sight [6] from the archer's eye to the target is offset from the longitudinal axis [5] defined by a nocked and drawn arrow. Axis [5] may also be called the shooting axis of the bow. The line of sight and the arrow's axis are nearly parallel in most cases except in extreme distance shooting or other unusual circumstances, so that a linear dimension of parallax 'p' can be defined between these axes [5] and [6.] An archer must develop skill in compensating for parallax so that while sighting a target an impact point can be visually estimated. Some bows have sighting aids such as beads mounted on horizontal studs protruding from the bow and usually mounted above the bow grip.

It is possible to draw the bow string to a point where a part of the string may touch the user's nose. If a wrist release or an arrow nock grasps the bow string at a uniform and repeatably locatable point along its length, then, if the archer fully extends his or her forearm which grips the bow, then, if the bow can be drawn to a repeatable depth and if the parallax can be repeatably re-established, then the entire geometry defining an amount of stored energy to be transferred to the arrow and the relationship between the archer's line of sight and the impact point of the arrow can also be repeatably controlled from one shot to the next.

The first repeatable constraint of the above is to nock the arrow at the same point of the bow. This challenge may be solved by various means such as by marking the string where the nock is supposed to receive it or by making a pair of such marks whereby the arrow is to be nocked at a midpoint between the marks. Some archers mark more than one position along a bow string for nocking an arrow to define a variety of launch angles for a drawn arrow, which all relate to a variety of arrow velocities and impact points which can be learned through experience and the building of muscle memory.

The second constraint is to store the same amount of mechanical potential energy available to be transferred to the arrow from one shot to the next. The invention aids in solving this second constraint by establishing repeatably identifiable point on the bow string, which point can be drawn until it touches the archer's nose. Reference numeral [2] illustrates such a contact point of the bow string touching an archer's nose.

The invention comprises an archery aiming aid which clamps onto a bow string at a position whereby an archer may draw the bow so that the bead contacts the archer's nose. Using a nose button in accordance with the invention, an archer is able to hold a bow in a repeatable configuration or geometry comprising outstretched limbs and relative positions of the hands, the bow grip, the depth of draw of the bow string, the apex of the drawn bow string and an arrow nocked therein, and other factors relating to the mechanical energy stored in the bow and imparted to the arrow when released.

With practice, an archer is able to build muscle memory so that from one shot to the next the archer may repeatably re-establish the same stored energy geometry in the body and bow, and repeatably re-establish the same parallax between the archer's line of sight and the shooting axis of the bow, so that improved uniformity of trajectories is achieved, point of impact is learned and controlled more accurately, and thus the archers accuracy and effectiveness is increased. The use of a nose button firmly mounted to a bow string may greatly aid in reestablishing the geometrical parameters that define stored energy and parallax of the archer and bow.

For maximum accuracy while using the invention for shooting a bow and arrow, an archer establishes a set of consistent set of "anchor points," which are points of contact with the archer's face. Contact with a taut bowstring and the face can create an ambiguous contact sensation when more than a small portion of the string lays along or embeds into the flesh of the face, because the contact interface becomes a long ellipse instead of a small, focused point. The inventive nose button offers a best mode "anchor point" for an archer to repeatedly achieve the exact same facial contact point shot after shot, and solves both the problem of inconsistent parallax between the archers line of sight and the shooting axis of the bow, and the problem of storing a consistent amount of stored energy in the bow from shot to shot.

Figure 2:
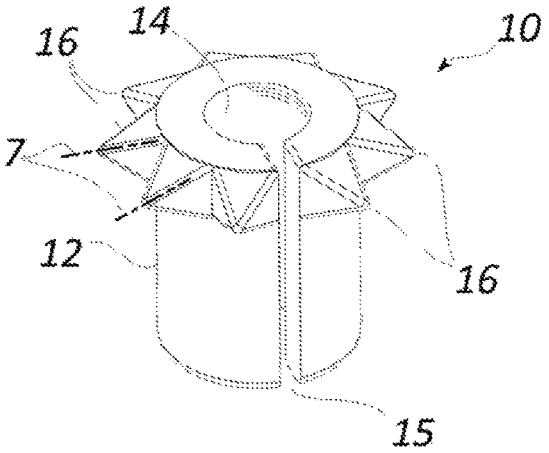
FIG. 2 shows an embodiment of a nose button in accordance with the invention.

FIG. 2 shows an embodiment of a nose button [10] in accordance with the invention. The bead comprises an open seam tube [12] that defines a longitudinal axis. An open seam tube in this specification is also called a split tube and it is a tube with is a split, gap, or a slit [15] that extends over its the entire length. The bead has an interior passage or lumen [14] which also extends the entire length of the bead. A radially spaced array of radial projections [16] extend radially outward and substantially perpendicular to the longitudinal axis of the bead. Each projection further defines its own axis of projection [7,] and in a preferred embodiment in accordance with the invention, the radial projections all lie in a plane perpendicular to the longitudinal axis of the split tube, so that regardless of the twist of the bow string or the angular orientation of the bead, when the bow string is drawn and all other parameters are re-established, the bow will shoot the arrow so that it will fly to a predictable and repeatable point of impact.

The radial projections have at least one portion which tapers along its axis of projection, so as to minimize the size of the contact area between the bead and the archer's face, which maximizes accuracy by allowing the archer to learn to feel for the location of a small point of contact on the face with finer resolution, which allows more accurate sensation and control of the anchor point. In a best mode use, the nose button is adjusted to a point on the bowstring so that it contacts a point on the archer's nose. A projection may taper to a frustum, which in this specification means a face of smaller area than the root contact of the projection to the tube, or it may taper to a point or a rounded or blunted point.

Figure 3:
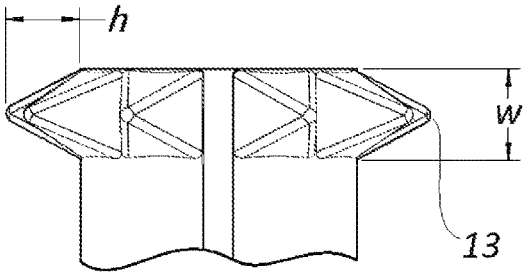
FIG. 3 shows a portion of the embodiment of the nose button shown in FIG. 2.

FIG. 3 shows a portion of the embodiment of the nose button shown in FIG. 2. The radial projections are located at an end of the open seam tube. The radial projections in this embodiment are pyramids which define a root width dimension 'w' at their attachment to the outer surface of the open seam tube. In this case the pyramids have apices which all lie in a plane perpendicular to the longitudinal axis of the tube, and the pyramids are symmetrical about this plane, so that the plane wherein the apices reside is located about w/2 from the end of the tube. When each of the projections have a root width dimension and the projections each converging to an apex, in a preferred embodiment each apex resides in a plane perpendicular to said longitudinal axis. The projections extend radially away from the longitudinal axis of the tube to a height dimension 'h' along its axis of projection, and in a preferred embodiment height 'h' taken along its axis of projection is at least 80% of its root width 'w,' and is preferably within a range of 100% to 150% of width 'w.'

The number of radial projections around the nose button is preferably at least three. Although the illustrated embodiments show seven arranged in a circumference, a radial array comprising a larger number of projections is also within the scope of the invention. Also the projections may a four-sided pyramids or other polygon cross sections. A projection may also be a cone having a round or elliptical cross section, and may taper to an apex or be a frustum.

A projection may also be a segment of a sphere, in which case its axis of projection is defined by an axis originating at and perpendicular to the longitudinal axis of the split tube, and passing through the centroid of the sphere. Cross sections through the sphere taken at points on its projection axis beyond the centroid of the sphere become smaller the further they are from the longitudinal axis of the split tube, and in this specification the words 'taper,' and 'tapering' include any reduction in cross sectional area of a projection with increasing distance from the longitudinal axis of the tube.

In the case of round or elliptical cross section, the root width dimension 'w' as defined above is a diameter dimension. Thus an embodiment of an open seam tube wherein at least three radial projections each comprise a pyramid, with each pyramids including an apex, and with each apex residing in a plane perpendicular to the longitudinal axis of the split tube also resides within the scope of the invention.

Figure 4:
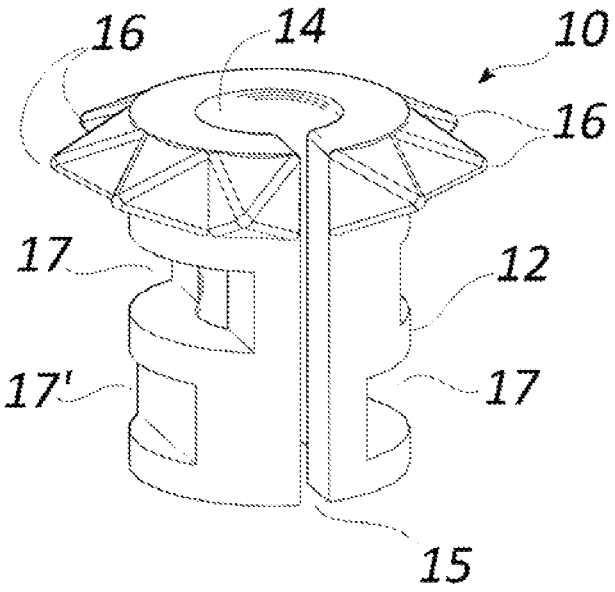
FIG. 4 shows an alternative embodiment of a nose button in accordance with the invention.

FIG. 4 shows an alternative embodiment of a nose button in accordance with the invention. In this embodiment [10] the open seam tube [12] has an inner lumen [14] and a gap or slot [15,] which makes it an open seam tube, and a radial array of projections [16.] Additional cutouts [17] in the wall of the tube can be deep enough to communicate with the lumen, or may be shallow cuts [17'] which do not communicate with the lumen. These cuts are used to control plastic flow when making the nose button as an injection molded plastic part. Uniform wall thicknesses are referred when designing molded or cast parts, and cutouts are used to divert or retard flow in some sections of the part so that the entire mold cavity can be filled efficiently or to reduce cosmetic defects in plastic parts such as shrink marks or gate blushes. The cuts [17] which communicate with the lumen may also include ridges which reduce the likelihood of a bead slipping out of its position on a bow string.

Figure 5:
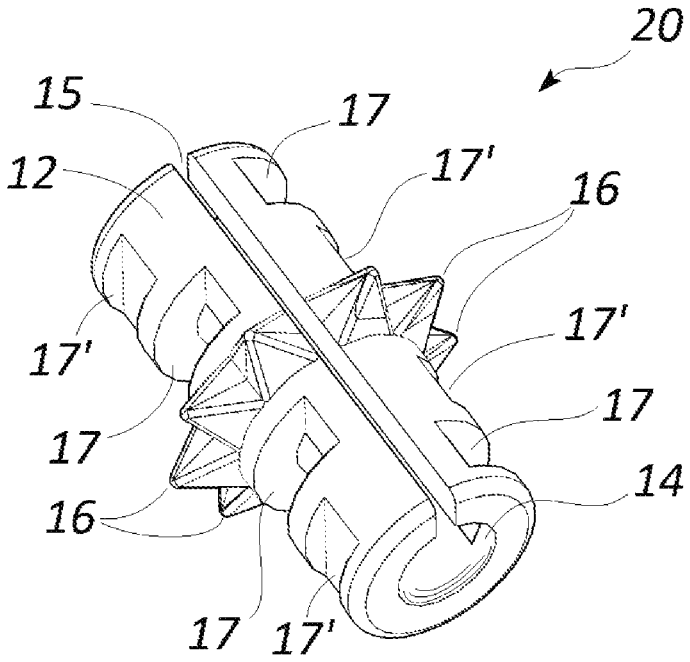
FIG. 5 shows another alternative embodiment of a nose button in accordance with the invention.

FIG. 5 shows another alternative embodiment of a nose button [20] in accordance with the invention. The open seam tube [12] has an inner lumen [14] and a gap or slot [15] along its entire length, and a radial array of projections [16.] Additional cutouts [17] in the wall of the tube can be deep enough to communicate with the lumen, or may be shallow cuts [17'] which do not communicate with the lumen.

In this embodiment the radial projections are pyramids which each taper to their own apex, and the apicies reside in a plane perpendicular to a longitudinal axis defined buy the tube. In this embodiment the plane is a transverse plane offset from an end of the open seam tube by one-half of said root width dimension. In this embodiment the plane may also be called a midplane.

Figure 6:
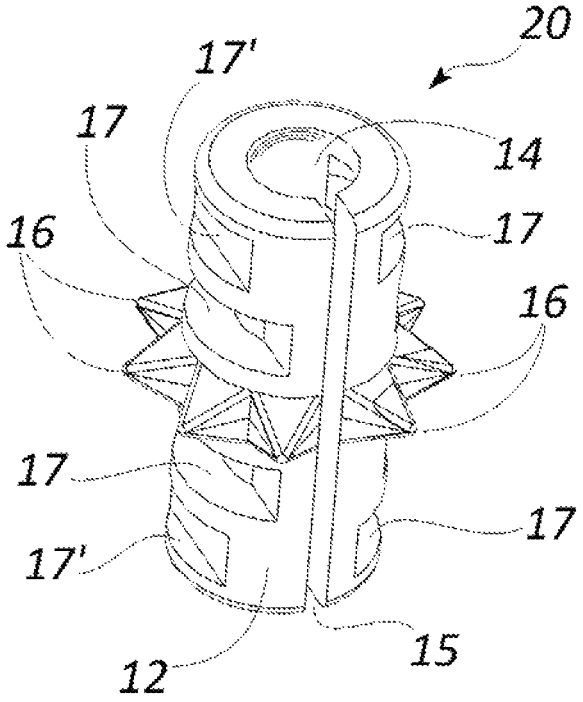
FIG. 6 shows an alternate view of the embodiment of the nose button shown in FIG. 5.

FIG. 6 shows an alternate view of the embodiment of the nose button [20] shown in FIG. 5. The open seam tube [12] has an inner lumen [14] and a gap or slot [15] along its entire length, and a radial array of projections [16.] Additional cutouts [17] in the wall of the tube can be deep enough to communicate with the lumen, or may be shallow cuts [17'] which do not communicate with the lumen.

Also, although in the illustrated embodiments, the split or gap in the open seam tube is straight, that it, it runs parallel to the longitudinal axis of the tube, splits of other shapes such as a diagonal split or a helical split also reside within the scope of the invention.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. An open seam tube defining a longitudinal axis, said tube further comprising a radially spaced array of radial projections, with each projection further defining an axis of projection and with all axes of projection residing in a plane perpendicular to said longitudinal axis, and at least a portion of at least one projection tapering along its axis of projection.

2. The open seam tube of claim 1, wherein at least one of said radial projections comprises a pyramid.

3. The open seam tube of claim 1, wherein at least one of said radial projections comprises a cone.

4. The open seam tube of claim 1, wherein at least one of said radial projections comprises a segment of a sphere.

5. The open seam tube of claim 1, wherein said plane perpendicular to said longitudinal axis is offset from an end of said open seam tube by one-half of said root width dimension.

6. The open seam tube of claim 1, wherein said plane perpendicular to said longitudinal axis is offset from an end of said open seam tube by one-half of a length of said open seam tube.

7. The open seam tube of claim 1, wherein a radial projection further comprises a root width dimension and a height dimension along its axis of projection, with said height dimension being at least 80% of said root width dimension.

8. The open seam tube of claim 1, wherein a radial projection further comprises a root width dimension and a height dimension along its axis of projection, with said height dimension being at within 100% to 150% of said root width dimension.

9. The open seam tube of claim 1, wherein at least four of said radial projections each comprise a pyramid, with each of said pyramids comprising an apex, and with each apex residing in said plane perpendicular to said longitudinal axis.

10. The open seam tube of claim 9, wherein at least one of said pyramids is a four-sided pyramid.

11. An open seam tube defining a longitudinal axis, said tube further comprising a radially spaced array of projections extending radially outward from said longitudinal axis, with each of said projections having a root width dimension and converging to an apex, and with each apex residing in a plane perpendicular to said longitudinal axis.

12. The open seam tube of claim 11, wherein at least one of radial projections comprises a pyramid.

13. The open seam tube of claim 11, wherein at least one of said pyramids is a four-sided pyramid.

14. The open seam tube of claim 11, wherein at least one of said radial projections comprises a cone.

15. The open seam tube of claim 11, wherein said plane perpendicular to said longitudinal axis is offset from an end of said open seam tube by one-half of said root width dimension.

16. The open seam tube of claim 11, wherein said plane perpendicular to said longitudinal axis is offset from an end of said open seam tube by one-half of a length of said open seam tube.

17. The open seam tube of claim 11, wherein a radial projection further comprises a root width dimension and a height dimension along its axis of projection, with said height dimension being at least 80% of said root width dimension.

18. The open seam tube of claim 11, wherein a radial projection further comprises a root width dimension and a height dimension along its axis of projection, with said height dimension being at within 100% to 150% of said root width dimension.

* * * * *